US005749414A

United States Patent [19]

Damsohn et al.

[11] Patent Number: 5,749,414

[45] Date of Patent: May 12, 1998

[54] CONNECTION BETWEEN TUBES AND TUBE BOTTOM FOR A HEAT EXCHANGER

[75] Inventors: Herbert Damsohn, Aichwald; Albert Schmitz, Simmozheim, both of Germany

[73] Assignee: BEHR GmbH & Co., Stuttgart, Germany

[21] Appl. No.: 766,048

[22] Filed: Dec. 16, 1996

Related U.S. Application Data

[63] Continuation of Ser. No. 359,190, Dec. 19, 1994, abandoned.

[30] Foreign Application Priority Data

Dec. 22, 1993 [DE] Germany ..... 43 43 825.3

[51] Int. Cl.[6] ..... F28F 9/18

[52] U.S. Cl. ..... 165/178; 165/158; 165/173; 219/121.64; 228/183

[58] Field of Search ..... 165/151, 153, 165/158, 173, 175, 178; 29/890.043, 890.054; 228/183; 219/121.63, 121.64

[56] References Cited

U.S. PATENT DOCUMENTS

| | | | |
|---|---|---|---|
| 3,257,710 | 6/1966 | Brown et al. | 165/173 X |
| 3,540,529 | 11/1970 | Umino et al. | 165/173 X |
| 4,066,861 | 1/1978 | Broodman | 165/173 X |
| 4,535,214 | 8/1985 | Meyer et al. | 228/183 X |
| 4,606,491 | 8/1986 | Le Mong | 228/183 X |
| 4,617,990 | 10/1986 | Franzolini et al. | 165/173 |
| 4,694,136 | 9/1987 | Kasner et al. | 219/121.64 |
| 4,965,431 | 10/1990 | Monteleone . | |
| 5,036,913 | 8/1991 | Murphy et al. . | |
| 5,048,602 | 9/1991 | Motohashi et al. . | |
| 5,186,244 | 2/1993 | Joshi . | |
| 5,524,831 | 6/1996 | Seki | 219/121.64 |

FOREIGN PATENT DOCUMENTS

| | | | |
|---|---|---|---|
| 0 326 813 | 8/1989 | European Pat. Off. . | |
| 0 396 132 | 11/1990 | European Pat. Off. . | |
| 2 121 757 | 8/1972 | France . | |
| 2639693 | 3/1978 | Germany | 165/158 |
| 30 36 427 | 4/1981 | Germany . | |
| 3622266 | 2/1987 | Germany . | |
| 4106296 | 9/1992 | Germany . | |
| 4118791 | 12/1992 | Germany . | |
| 4120442 | 12/1992 | Germany . | |
| 293691 | 12/1986 | Japan | 219/121.64 |
| 107889 | 5/1987 | Japan . | |
| 1140916 | 2/1985 | U.S.S.R. | 228/183 |
| 2 065 811 | 7/1981 | United Kingdom . | |

OTHER PUBLICATIONS

Japanese Abstract No. 59–50986, vol. 8, No. 154 (M–310 (1591), Jul. 18, 1984.

*Welding International*, vol. 6, No. 9, 1992, entitled "Practical application of high–power YAG laser welding by optical fibre transmission" by A. Yokoyama et al., pp. 740–745.

*Primary Examiner*—Leonard R. Leo

*Attorney, Agent, or Firm*—Evenson, McKeown, Edwards & Lenahan PLLC

[57] ABSTRACT

A heat exchanger assembly and method of making same are disclosed. A plurality of thin walled aluminum tubes are connected to a tube bottom. The tubes are first inserted into the tube support openings in the tube bottom with tube ends flush with a collecting space side of the tube bottom. The tube ends are then welded by a laser beam guided around the circumference of the respective tube ends.

13 Claims, 1 Drawing Sheet

CONNECTION BETWEEN TUBES AND TUBE BOTTOM FOR A HEAT EXCHANGER

BACKGROUND AND SUMMARY OF THE INVENTION

This application is continuation of application Ser. No. 08/359,190, filed on Dec. 19, 1994, now abandoned.

This invention relates to a connection between the tubes and the tube bottom for a heat exchanger comprising a tube block through which a heat exchange medium flows and which has tubes made of aluminum which extend in parallel to one another and which are held at least by means of one end in a tube bottom made of aluminum which adjoins a collecting tank and are tightly connected with this tube bottom, particularly a radiator for motor vehicle engines.

The connections between the tubes and bottoms for heat exchangers, particularly for radiators of motor vehicle engines, but also for condensers, evaporators or charge air coolers, always have certain problems because, on the one hand, the tube ends inserted into the tube bottoms must have a mechanically firm hold and, on the other hand, the required tightness must be achieved in order to avoid losses of the heat exchange medium. For heat exchangers with aluminum tubes and an aluminum bottom, it is known to insert the tubes in so-called passages of the bottom and to solder them. However, as a rule, a separate sealing operation must still be carried out subsequently by using silicone. This requires relatively expensive operations for the soldering and, because soldered heat exchangers do not achieve the required tightness, a subsequent cleaning operation with agents which are not harmful to the environment as well as subsequently the process of the silicone treatment.

It is also known to mechanically expand the tube ends inserted in passages of the tube bottom and to provide a rubber seal. Problems occur here because of the tearing of the tube ends to be expanded and as a result of displaced seals, particularly when there are no round tube cross-sections. In this case, the sealing becomes particularly difficult.

It is therefore an object of the invention to construct a connection between the tubes and the tube bottom of the initially mentioned type in such a manner that the requirements are met with respect to the mechanical hold and the sealing tightness.

Based on connections between the tubes and the tube bottom of the initially mentioned type, the invention comprises a system where the tube ends pushed into the tube bottom are welded to the tube bottom by means of a laser weld seam extending along their whole circumference, the inner contour of this weld seam merging flush into the interior tube wall and into the side of the tube bottom which faces the interior of the collecting space.

As a result of this development, it is possible to achieve the required mechanical hold as well as the required tightness in only one operation. Additional operations for a silicone treatment or an additional inserting of seals become superfluous. It was also found that, as a result of the invention, it becomes possible in a simple manner to also weld tubes of complicated cross-sections, particularly flat tubes of an oval or elliptical cross-section, or multichamber profiles, to the tube bottom in a sufficiently firm and tight manner. The tube bottom proper no longer requires passages. The only requirement is to adapt the openings in the tube bottom to the tube cross-section in a correspondingly precise manner. Finally, the weld seam produced according to the invention also represents no resistance to the flow in the heat exchanger because there is no longer any tube projection as in the state of the art. In this manner, tube material can also be saved.

It should also be stressed that, as a result of the invention, it becomes possible in a very simple manner to connect the tube bottoms of a considerably larger thickness with the tubes.

For producing a connection between the tubes and the tube bottom according to the invention, it was found to be particularly advantageous for the openings in the tube bottom to be at first designed such that the tube ends are held in the openings largely without any gap, that the tube ends are then pushed into their assigned openings in such a manner that they extend flush with the side of the tube bottom adjoining the collecting space, and that then the laser welding takes place by means of a laser beam guided along the circumference of the tube ends. In this case, this laser beam works successively on each tube and, for this purpose, is guided from tube to tube corresponding to the dimensions of the tube bottom and of the tubes and then correspondingly along the circumference of the tube.

For the production, it is also very advantageous for the joining gap between the tube ends and the assigned openings of the tube bottom to be smaller than 0.1 mm all around. The laser welding may also take place in inert gas, specifically by means of a tunable ND/YAG laser.

Other objects, advantages and novel features of the present invention will become apparent from the following detailed description of the invention when considered in conjunction with the accompanying drawings.

DETAILED DESCRIPTION OF THE DRAWINGS

Figure 1:
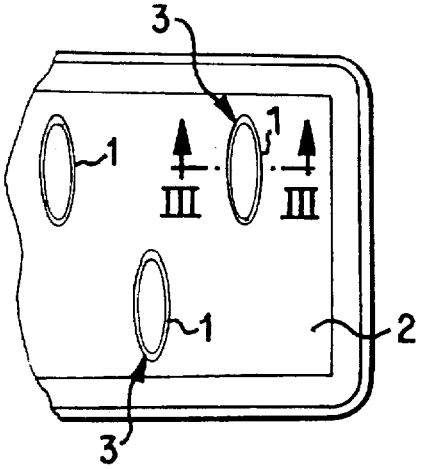
FIG. 1 is a cut-out of a top view of a tube bottom of a radiator for a motor vehicle engine comprising welded-in tubes which have an oval cross-section, constructed according to a preferred embodiment of the present invention.
Figure 3:
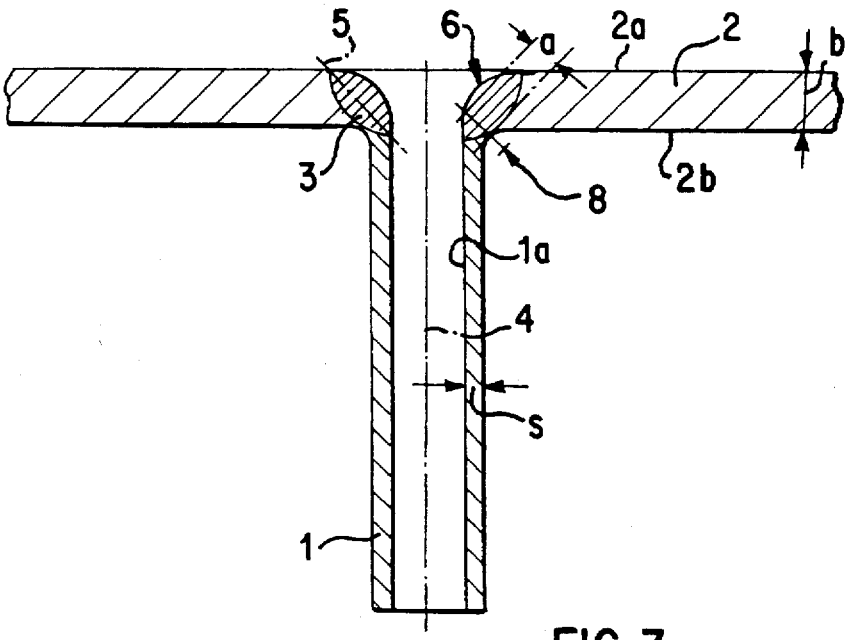
FIG. 3 is a further enlargement of the representation of the sectional view III—III of FIG. 1 with the welded-in tube.

FIGS. 1 and 3 show that the connection between the tubes and the tube bottom according to the invention for the heat exchanger used as the radiator for motor vehicle engines was made between several flat tubes 1 made of aluminum, which are arranged in a manner known per se and are also provided in a manner not shown with a network of cooling ribs, and a tube bottom 2 which is also made of aluminum. In this case, the axes 4 of the tubes are in each case aligned perpendicularly to the tube bottom 2. They have a wall thickness(s) which in the case of the embodiment shown, is much less than the thickness (b) of the tube bottom 2. The thickness (b) amounts to approximately three times the wall thickness (s) of the tubes 1.

The tubes 1 are connected with this tube bottom 2 by a weld seam 3 which extends along their whole circumference and which, as illustrated in FIG. 3, has an approximately oval cross-section with tapering ends whose longitudinal axis 5 extends at approximately 45° with respect to the tube bottom 2 and to the tube axes 4. The weld seam 3, which was produced by a laser beam, extends in this case from side 2a of the tube bottom 2 facing the collecting space for the heat exchange medium which is not shown to below the underside 2b of the tube bottom 2. It has a rounded inner contour 6 which faces the tube mouth and which in each case changes tangentially into the side wall 2a of the tube bottom 2 and into the interior wall 1a of the tubes 1. The weld seam therefore forms a sort of feed hopper at the mouth area of the tubes. It does not project beyond the interior wall 2a at any point.

Figure 2:
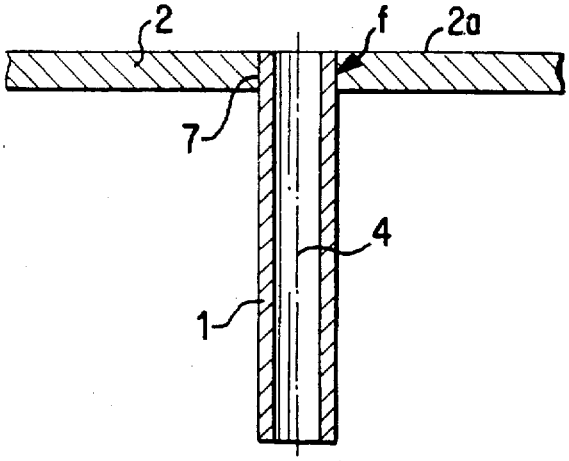
FIG. 2 is an enlarged representation of the sectional view of a tube bottom connection along the intersecting Line III—III in FIG. 1 but before the welding operation.

In order to achieve this shape of the weld seam, which is extremely advantageous from a fluidic point of view because there is no longer a projecting of the tubes, all tubes 1, as illustrated in FIG. 2, are first pushed with their tube ends into assigned openings 7 of the tube bottom 2 in such a manner that their ends extend flush with respect to the side 2a. In this case, the joining gap (f) existing between the openings 7 and the outer circumference of the tubes 1 must be selected such that it is smaller than 0.1 mm all around. If the tubes are aligned and arranged in this manner, the weld seam 3 is produced by means of a tunable ND-YAG laser beam which is guided from the direction of the side of the collecting space from tube to tube and there in each case along the whole circumference of the end of the tube 1. The laser beam therefore works on all tubes 1 successively on the side extending flush in the tube bottom 2. The weld seam will then be formed in the shape illustrated in FIG. 3. At the point 8, measured at an angle of 45°, which the bisecting line of the angle takes up between the underside 2b of the tube bottom 2 and the exterior wall of the tube 1, the weld seam is larger than (s).

This shape of the weld seam, which is the result of the special laser welding, provides the connection between the tubes and the tube bottom with an extremely good stability. It is also contemplated by the invention to simultaneously weld several tubes to the tube bottom by means of several lasers or—because the hold pattern in the tube bottom is regular—by means of beam splitting.

Figure 1A:
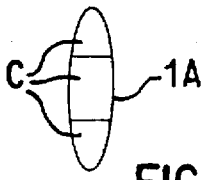
FIG. 1A is a schematic top view of a tube constructed according to another preferred embodiment of the present invention.

FIG. 1A schematically depicts a modified tube 1A which includes multiple chambers C.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A heat exchanger assembly for a motor vehicle radiator comprising:

an aluminum tube bottom adjoining a collecting tank which defines a collecting space, a plurality of aluminum tubes extending parallel to one another and having respective tube ends thereof fully inserted into respective tube bottom openings having uniform cross-sections, and laser weld seams, formed only from the tube ends and a portion of the tube bottom, surrounding an entire circumference of each of the respective tube ends to sealingly connect the tube ends in the respective tube bottom openings, wherein each laser weld seam exhibits an inner contour extending from a position flush with an interior tube wall surface to a position flush with a side of the tube bottom facing an interior of the collecting space, wherein each respective weld seam, measured at an angle of 45° at an intersecting point between an outer tube wall and an underside of the tube bottom, has a thickness which is larger than the thickness of the tube wall.

2. An assembly according to claim 1, wherein respective tube axes of each tube are disposed perpendicularly with respect to the tube bottom, and wherein each weld seam has a cross-section in the shape of an oval whose longitudinal axis extends at an angle of approximately 45° with respect to the tube axis.

3. An assembly according to claim 2, wherein the thickness of the tube bottom is clearly larger than the thickness of the tube wall.

4. An assembly according to claim 3, wherein each respective weld seam extends into an area of an associated tube which is situated at a distance from a side of the tube bottom which faces away from the collecting space.

5. An assembly according to claim 1, wherein the thickness of the tube bottom is clearly larger than the thickness of the tube wall.

6. An assembly according to claim 1, wherein each respective weld seam extends into an area of an associated tube which is situated at a distance from a side of the tube bottom which faces away from the collecting space.

7. An assembly according to claim 1, wherein the tubes are constructed as oval tubes.

8. An assembly according to claim 7, wherein the inner contour of each respective weld seam is rounded so that a type of feed hopper is created at a mouth of the tube.

9. An assembly according to claim 7, wherein the tubes have an oval or elliptical cross-section.

10. An assembly according to claim 1, wherein the tubes are construed as multichamber profiles with a flat cross-section.

11. An assembly according to claim 1, wherein said plurality of aluminum tubes have non-circular cross-sections.

12. A heat exchanger assembly for a motor vehicle radiator comprising:

an aluminum tube bottom adjoining a collecting tank which defines a collecting space, a plurality of aluminum tubes extending parallel to one another and having respective tube ends thereof fully inserted into respective tube bottom openings having uniform cross-sections, and laser weld seams, formed only from the tube ends and a portion of the tube bottom, surrounding an entire circumference of each of the respective tube ends to sealingly connect the tube ends in the respective tube bottom openings, wherein each laser weld seam exhibits an inner contour extending from a position flush with an interior tube wall surface to a position flush with a side of the tube bottom facing an interior of the collecting space, wherein each respective weld seam, measured at an angle of 45° at an intersecting point between an outer tube wall and an underside of the tube bottom, has a thickness which is larger than the thickness of the tube wall, and wherein the inner contour of each respective weld seam is rounded so that a type of feed hopper is created at a mouth of the tube.

13. An assembly according to claim 12, wherein said each respective weld seam has a maximum thickness of more than twice the thickness of the tube wall.

* * * * *